US006659832B1

(12) United States Patent
Chen

(10) Patent No.: US 6,659,832 B1
(45) Date of Patent: Dec. 9, 2003

(54) BOOMERANG FOR SPORT

(75) Inventor: Ing-Chun Chen, Taichung (TW)

(73) Assignee: Precision Machinery Research & Development Center, Taichung (TW)

( * ) Notice: Subject to any disclaimer, the term of this patent is extended or adjusted under 35 U.S.C. 154(b) by 0 days.

(21) Appl. No.: 10/365,125

(22) Filed: Feb. 12, 2003

(51) Int. Cl.[7] ..... A63H 27/00; A63B 65/08
(52) U.S. Cl. ..... 446/46; 473/590
(58) Field of Search ..... 446/47, 48, 34, 446/36, 61–67, 236; 473/590, 588, 589

(56) References Cited

U.S. PATENT DOCUMENTS

| | | | | | |
|---|---|---|---|---|---|
| 3,881,729 | A | * | 5/1975 | Block et al. | 473/590 |
| 5,199,717 | A | * | 4/1993 | Wimmer | 473/590 |
| 5,615,892 | A | * | 4/1997 | Miller | 473/590 |
| D389,878 | S | * | 1/1998 | Tylor | D21/437 |
| 6,179,738 | B1 | * | 1/2001 | Perthou | 473/590 |

FOREIGN PATENT DOCUMENTS

| | | | |
|---|---|---|---|
| JP | 112382 | * | 5/1996 |
| JP | 159604 | * | 6/2002 |
| WO | WO 98/26844 | * | 6/1998 |

OTHER PUBLICATIONS

US 20030083160A1, Ben–Hador, May 2003.*
US 20010024923A1, Streit, Sep. 2001.*

* cited by examiner

*Primary Examiner*—Jacob K. Ackun
*Assistant Examiner*—Faye Francis
(74) *Attorney, Agent, or Firm*—Darby & Darby

(57) ABSTRACT

A boomerang is made from a flat sheet material, and includes a plurality of blades connected to a central body by a plurality of interconnecting portions, and angularly displaced from one another about a center point. Each blade includes leading and trailing edges that are symmetrical relative to a middle line. Each interconnecting portion extends along a radial axis which intersects the middle line to form an obtuse included angle therewith. Each blade has a bent line that is positioned between the middle line and the trailing edge thereof, and cooperates with the trailing edge to define a bent portion which faces towards the leading edge and which forms an obtuse included angle with a horizontal plane. Varying the position of the bent lines and the included angles of the bent portions can change flight patterns and flight range of the boomerang.

5 Claims, 10 Drawing Sheets

BOOMERANG FOR SPORT

BACKGROUND OF THE INVENTION

1. Field of the Invention

This invention relates to a boomerang for sport, more particularly to a boomerang made from a flat sheet material of a reduced weight so as to ensure safety.

2. Description of the Related Art

Boomerangs, which have been used for sport in recent years, are devices capable of being thrown by a user, flying in a continuous path, and returning to the point of launching. Referring to FIGS. 1 to 3, two conventional boomerangs 5, 6 are shown to include two arms 51,52 and three arms 61, respectively. Each arm 51,52,61 is designed to have an airfoil thickness such that, when the boomerang 5,6 is thrown, air flows over its leading edge 511,521,611 and its trailing edge 512,522,612 to produce a lift force according to Bernoulli's law, and the boomerang 5,6 continues rotation until it returns to the point of launching. As such, the boomerang 5, 6 is required to have a sufficient thickness in order to produce the desired lift, thereby resulting in a greater weight thereof, which in turn results in a larger flight range. Therefore, the conventional boomerangs 5, 6 generally cannot be used in a relatively narrow area.

To overcome the above problem, referring to FIGS. 4 and 5, another conventional boomerang 7 was proposed. The boomerang 7 is made from a thin plate, and is shown to include four arms 71, each of which has two bent portions 711,712 so as to reduce the overall weight of the boomerang 7. However, as the flight path of the boomerang 7 is monotonous, the boomerang 7 is not interesting to play with.

SUMMARY OF THE INVENTION

The object of the present invention is to provide a sport boomerang which is capable of adjustable flight patterns and which has an adjustable flight range.

According to this invention, the boomerang is made from a flat sheet material, and includes a central body with an outer periphery surrounding a center point. The central body has top and bottom surfaces that are substantially parallel to each other and that are symmetrical relative to a horizontal plane. A plurality of interconnecting portions are integrally formed with the outer periphery of the central body, and are angularly displaced from one another about the center point. Each of the interconnecting portions extends outwardly and along a radial axis, and terminates at a boundary region. A plurality of blades are integrally and respectively formed with the interconnecting portions, and are angularly displaced from one another. Each of the blades includes leading and trailing edges which are opposed to each other in one of clockwise and counterclockwise directions when the blades are turned about an axis that is normal to the horizontal plane and that passes through the center point, and which are symmetrical relative to a middle line. Each of the blades further includes a distal end which is opposed to the boundary region along the middle line and which joins the leading and trailing edges, respectively, at leading and trailing junctures. The middle line intersects the radial axis to form an obtuse included angle therewith, which faces towards the leading edge. Each blade further includes a bent line which extends towards the distal end and which is positioned between the middle line and the trailing edge. A bent portion, which faces towards the leading edge, is defined by the bent line and the trailing edge. The bent portion forms an obtuse included angle with the horizontal plane.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
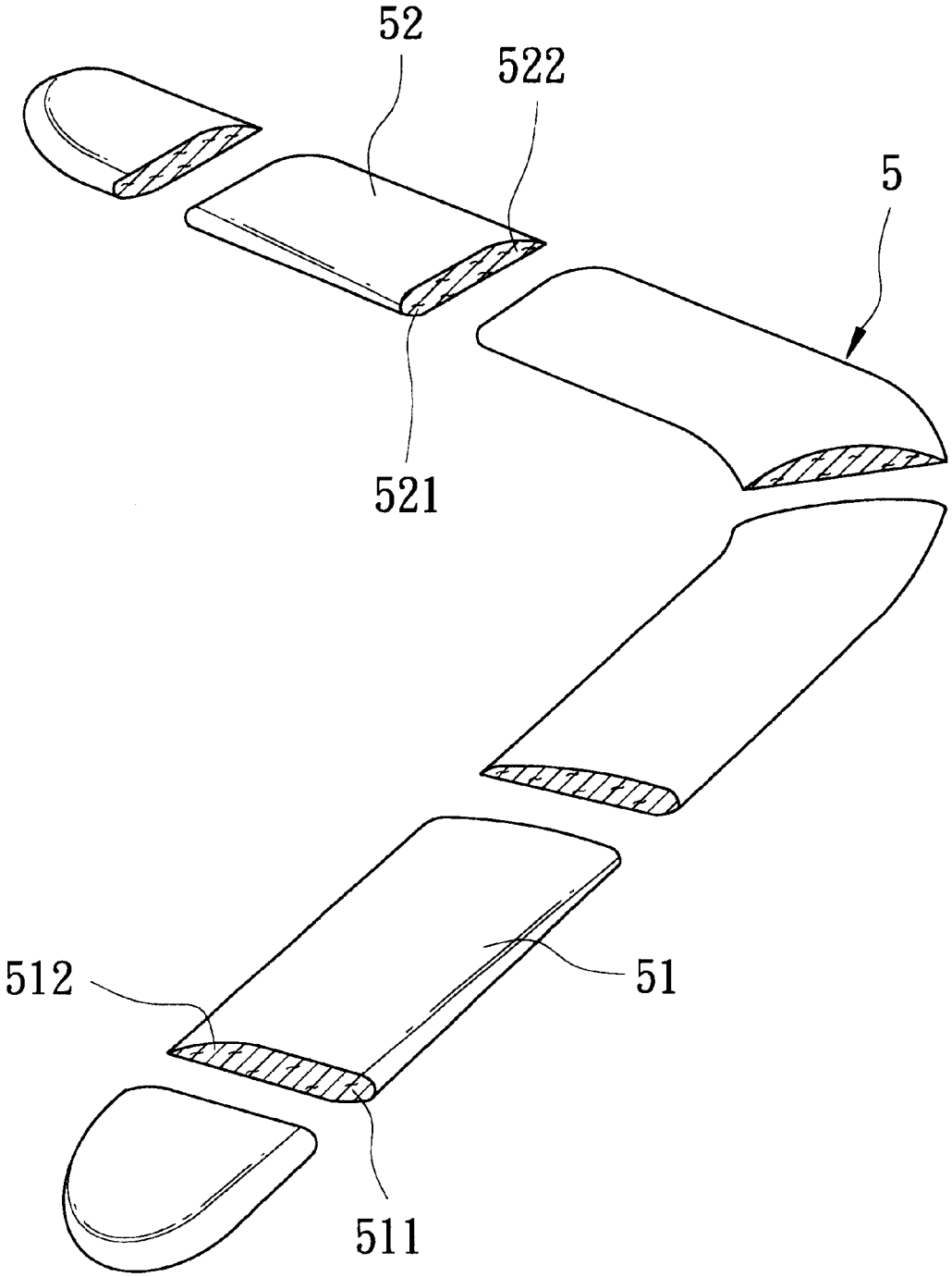
FIG. 1 PRIOR ART
FIG. 1 is a fragmentary perspective view of a conventional boomerang with two arms.
Figure 2:
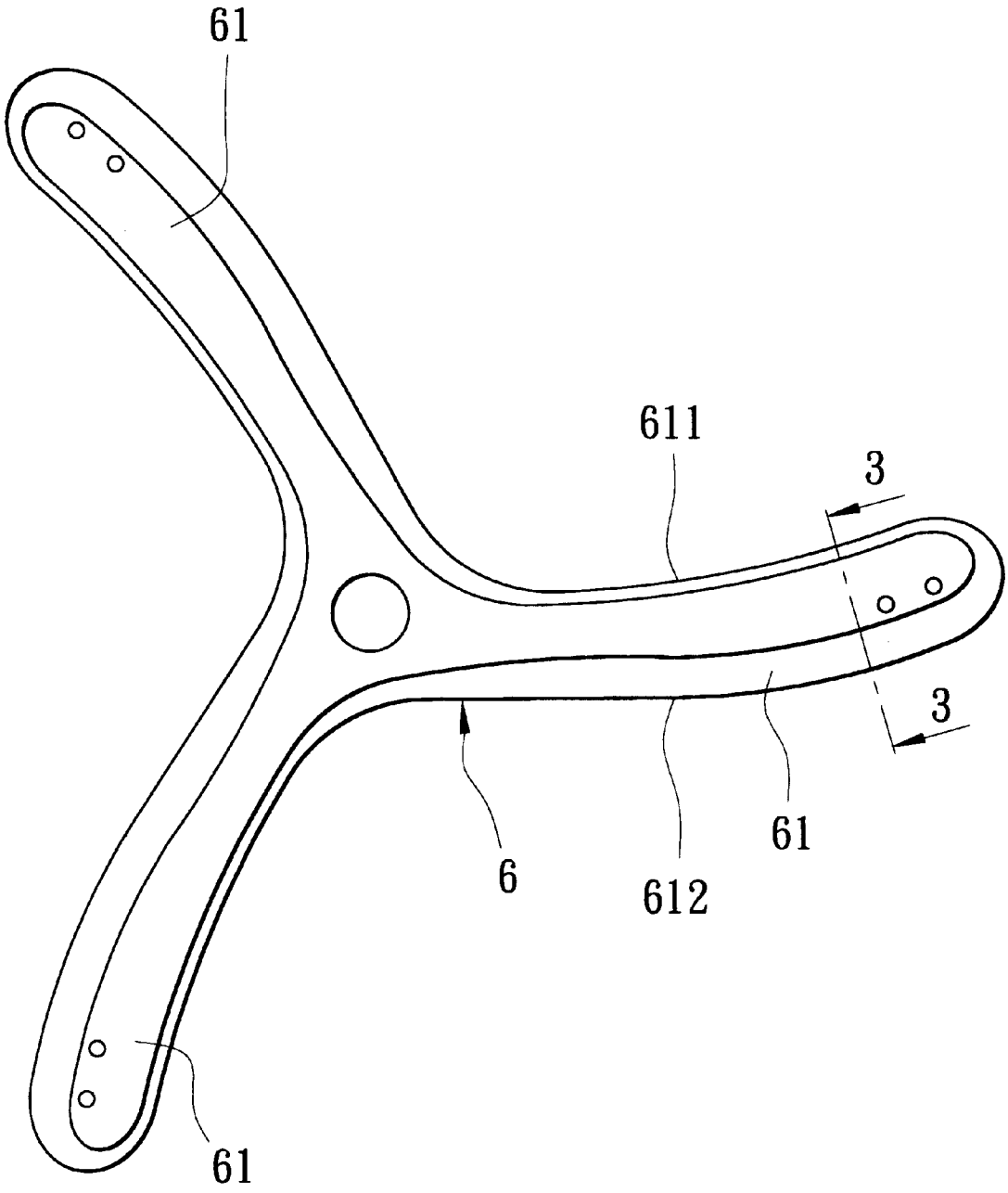
FIG. 2 PRIOR ART
FIG. 2 is a top view of a conventional boomerang with three arms.
Figure 3:
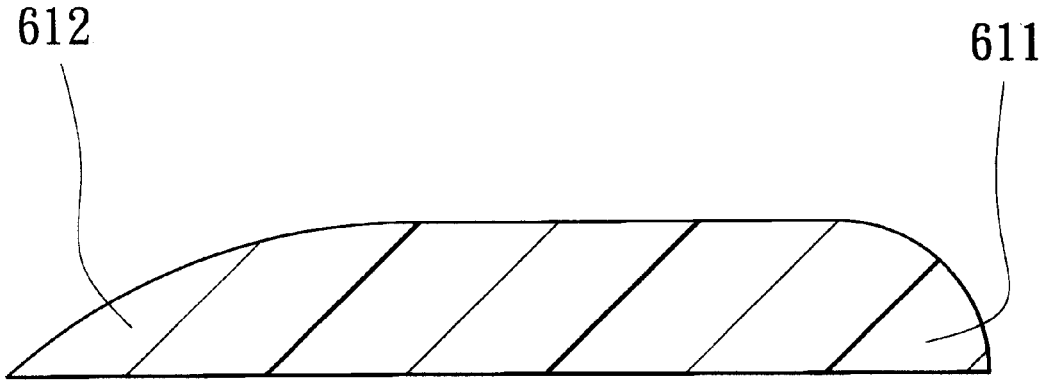
FIG. 3 PRIOR ART
FIG. 3 is a cross-sectional view of the boomerang shown in FIG. 2, taken along lines 3—3 thereof.
Figure 4:
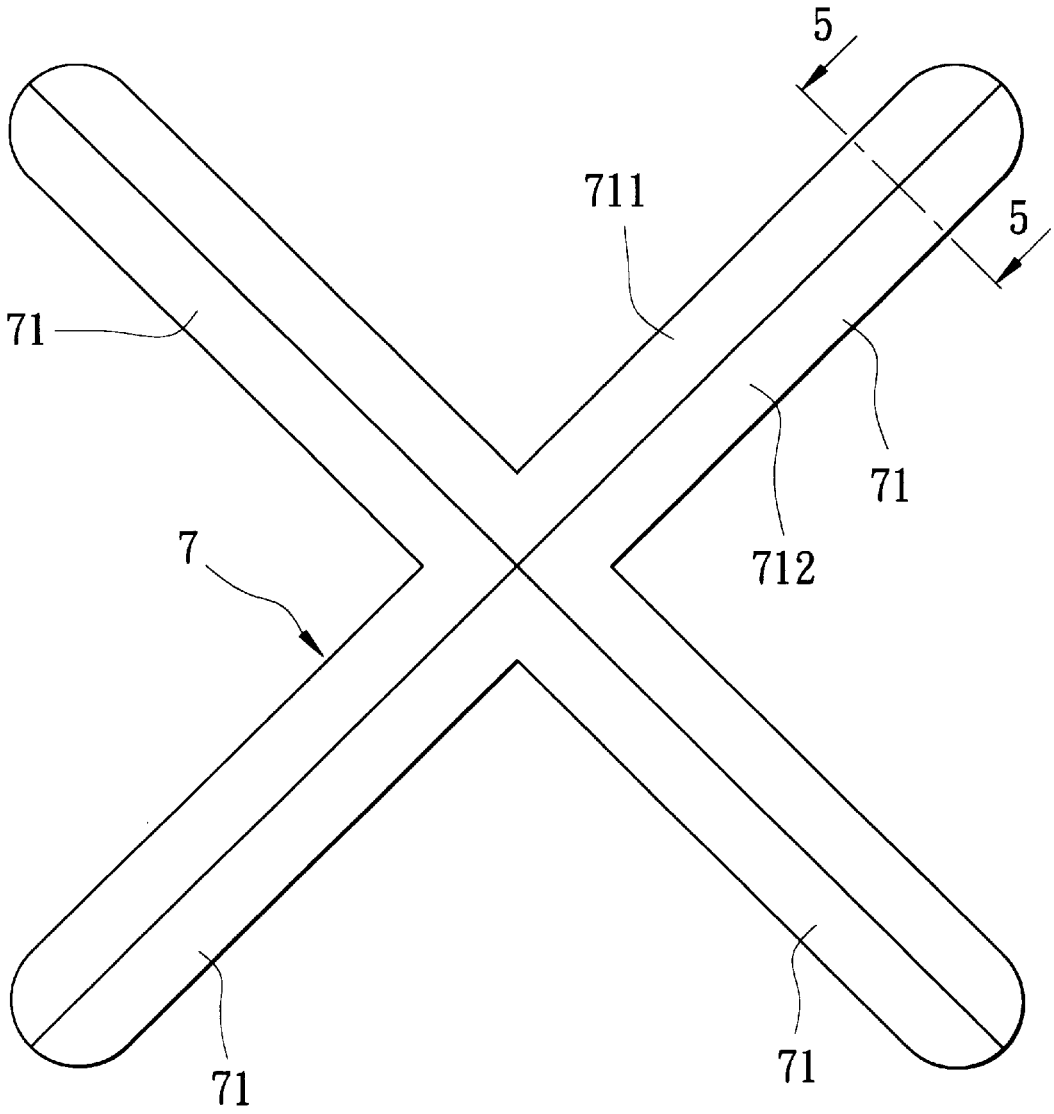
FIG. 4 PRIOR ART
FIG. 4 is a top view of a conventional boomerang with four arms.
Figure 5:
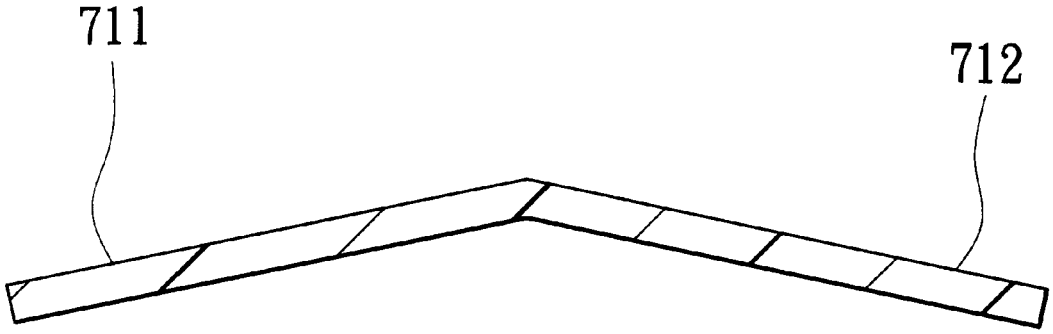
FIG. 5 PRIOR ART
FIG. 5 is a cross-sectional view of the boomerang shown in FIG. 4, taken along lines 5—5 thereof.
Figure 6:
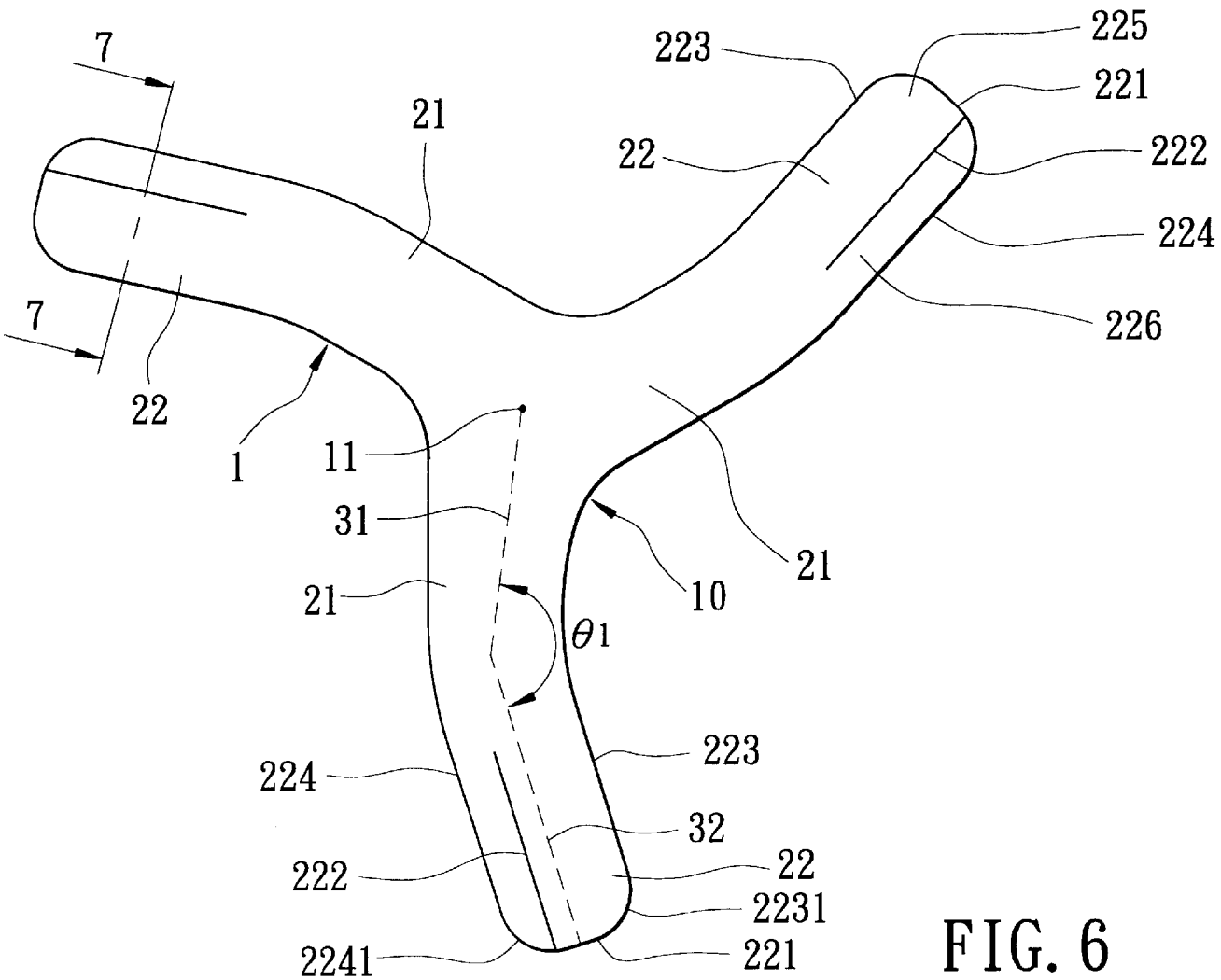
FIG. 6 is a top view of a preferred embodiment of a boomerang according to this invention.
Figure 7:
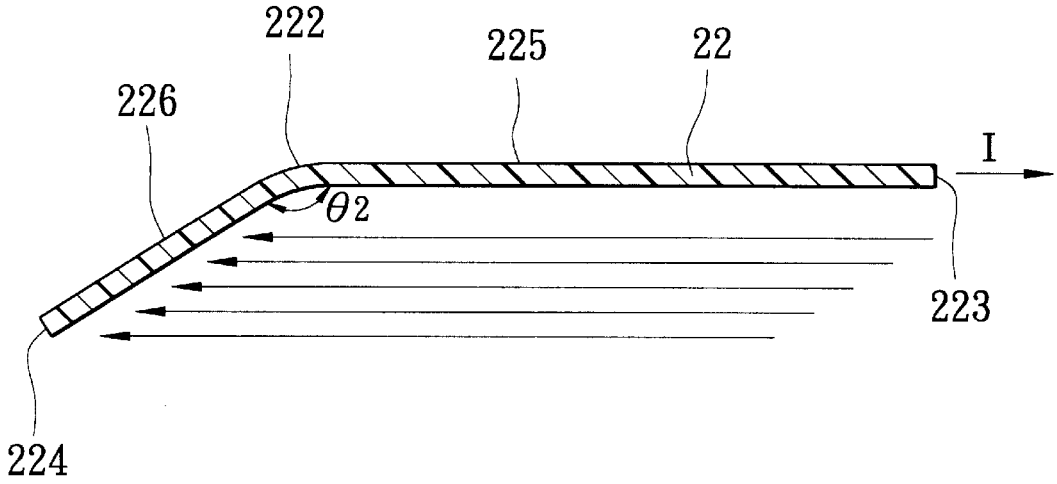
FIG. 7 is a cross-sectional view of the boomerang shown in FIG. 6, taken along lines 7—7 thereof.

Referring to FIGS. 6 and 7, the preferred embodiment of a boomerang 1 according to the present invention is formed from a thin, flat sheet material of a substantially uniform thickness that is less than 2 mm, and has a single-piece construction. The boomerang 1 is shown to be throwable by a right-handed user, and comprises a central body 10, three interconnecting portions 21, and three blades 22.

The central body 10 has an outer periphery surrounding a center point 11, and top and bottom surfaces that are substantially parallel to each other and that are symmetrical with respect to a horizontal plane. The interconnecting portions 21 are integrally formed with the outer periphery of the central body 10, and are angularly displaced from one another about the center point 11. Each of the interconnecting portions 21 extends outwardly and along a radial axis 31, and terminates at a boundary region. The blades 22 are integrally and respectively formed with the interconnecting portions 21, and are angularly displaced from one another. Each of the blades 22 includes leading and trailing edges 223,224 which are opposed to each other in one of clockwise and counterclockwise directions when the blades 22 are turned about an axis that is normal to the horizontal plane and that passes through the center point 11. In this embodiment, the leading and trailing edges 223,224 are opposed in the counterclockwise direction. The leading and trailing edges 223,224 are symmetrical with respect to a middle line 32. Each of the blades 22 further includes a distal end 221 which is opposed to the boundary region along the middle line 32 and which joins the leading and trailing edges 223,224, respectively, at leading and trailing junctures 2231, 2241.

The middle line 32 intersects the radial axis 31 to form an obtuse included angle 0 1 therewith, which faces towards the leading edge 223. In other words, each of the blades 22 curves toward an adjacent one of the blades 22 that is disposed forwardly thereof in turns of the direction of a spin.

Each of the blades 22 includes a bent line 222 which extends towards the distal end 221, which is in parallel to the middle line 32, and which is positioned between the middle line 32 and the trailing edge 224. Thus, a bent portion 226, which faces towards the leading edge 223, is defined by the bent line 222 and the trailing edge 224. Referring to FIG. 7, the bent portion 226 forms an obtuse included angle θ2 with the horizontal plane. In addition, a plane portion 225 is defined between the bent line 222 and the leading edge 223. The central body 10, the interconnecting portions 21 and the blades 22 are of substantially the same thickness.

Figure 8:
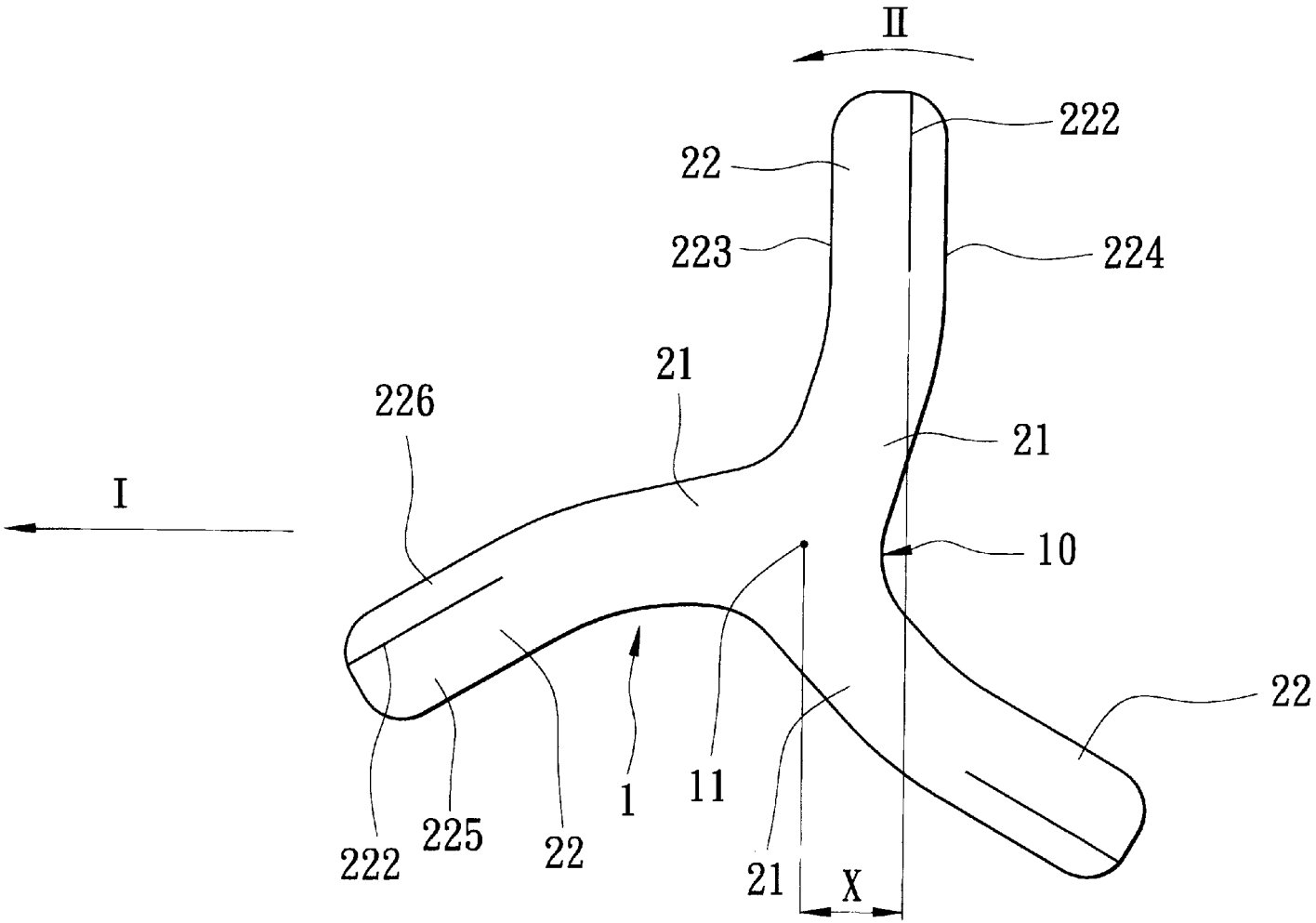
FIG. 8 is a top view illustrating the preferred embodiment in a state of flight.
Figure 9:
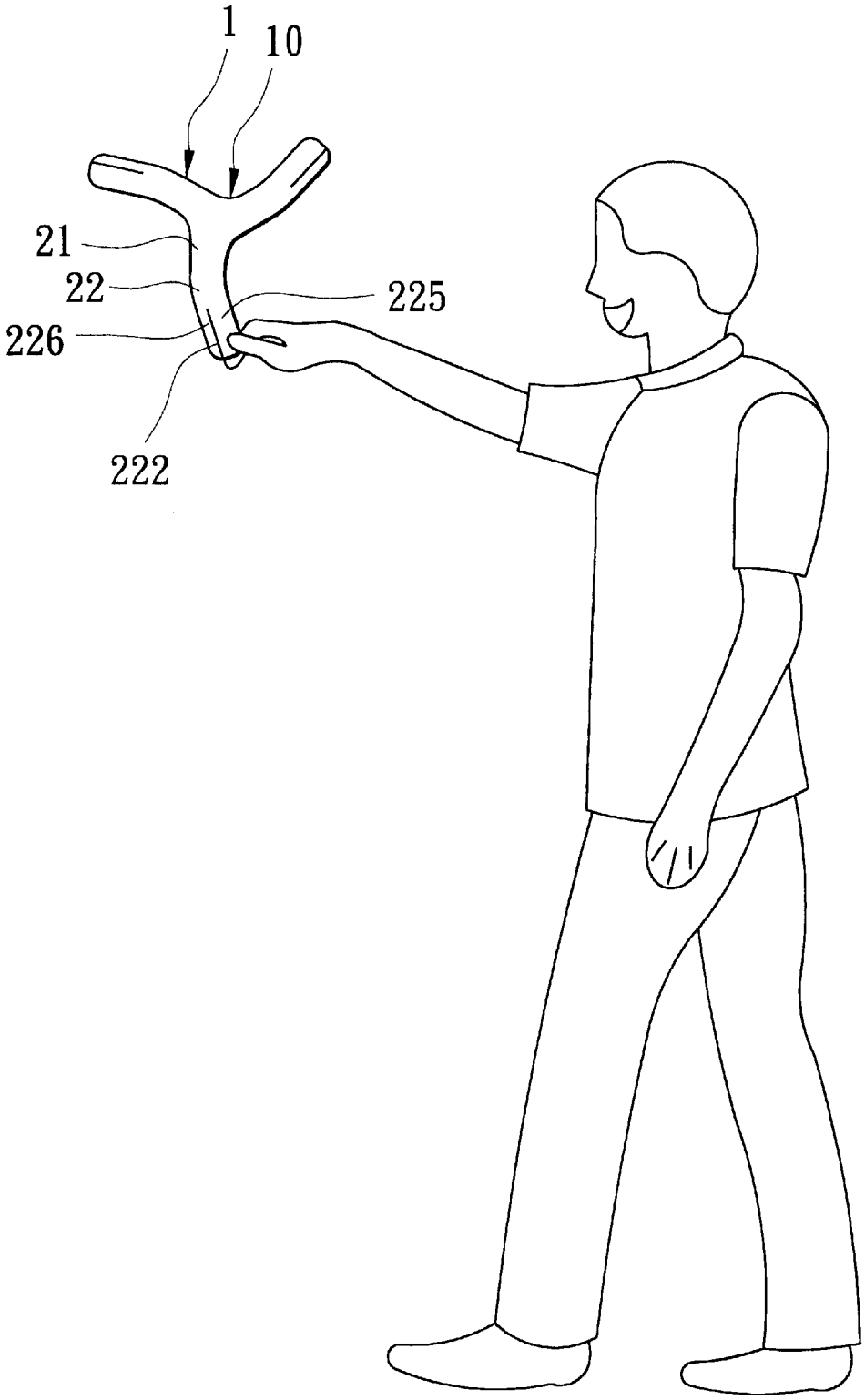
FIG. 9 is a schematic view illustrating how the preferred embodiment is held by the thrower.

With reference to FIG. 9, in combination with FIGS. 7 and 8, the thrower can hold the plane portion 225 of one of the blades 22, and then throw the boomerang 1 in a direction indicated by arrow (I). The boomerang 1 will rotate about the axis passing through the center point 11 in a direction indicated by arrow (II), and then return to the point of launching.

In particular, when the boomerang 1 is thrown with a spin in an almost vertical state (i.e. the axis passing through the center point 11 is parallel to the ground) so as to rotate through the air, due to the presence of the included angle θ2 between the bent portion 226 and the horizontal plane, a thrust is generated by airflow to act upon one side of the bent portion 226, thereby creating a lift at the other side of the bent portion 226 from right to left (as viewed by the thrower). Since there is more lift at the top of the spin than that at the bottom, the difference in lift forces results in a first torque that acts upon the substantially vertical boomerang 1 to cause it to fly leftward in a curve path. At the same time, as more lift is generated in front of the center point 11 (center of mass of the boomerang 1) than behind the center point 11, a second torque results to cause the boomerang 1 to lay down horizontally and rightwardly in a gradual manner while the boomerang 1 climbs to a highest point. Thereafter, the boomerang 1 will returns to the point of launching by virtue of residual rotational inertia. Therefore, the flight range of the boomerang 1 is in a direct proportion to the rotational inertia, and is in an inverse proportion to the lift.

Accordingly, referring to FIG. 8, since the bent line 222 of each blade 22 is offset from the center point 11 by an offset distance (X), and since the offset distance (X) can decrease the second torque, the height of flight of the boomerang 1 can be varied by adjusting amount of the offset distance (X). Besides, the flight range can be varied by adjusting length and width of the bent portions 226 and the included angle θ2.

Moreover, since the boomerang 1 according to this invention is made from a thin flat sheet material, it has a smaller rotational inertia so that a relatively small lift force is required for rotation thereof. Therefore, the boomerang 1 of this invention is lighter and safer.

Figure 10:
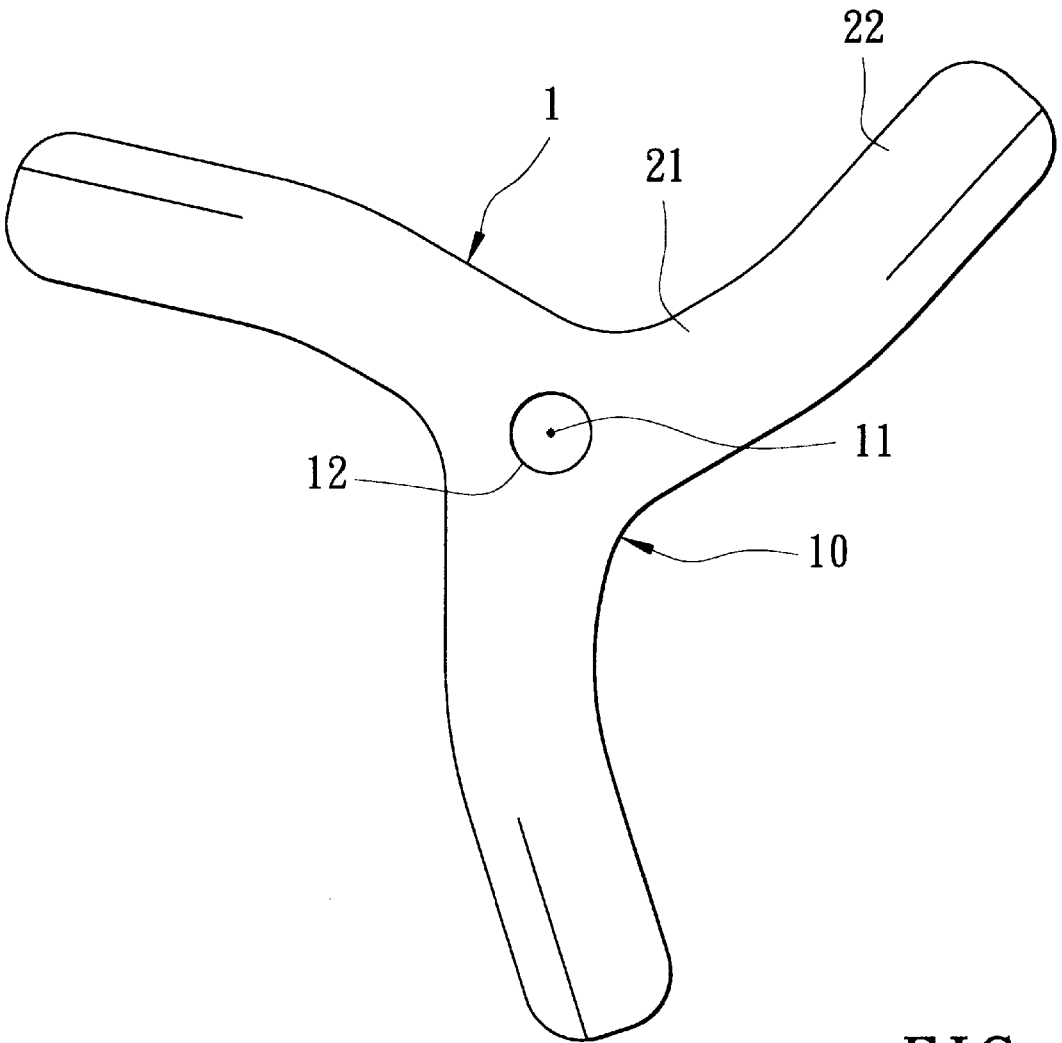
FIG. 10 is a top view of another preferred embodiment of the boomerang according to this invention.

Referring to FIG. 10, another preferred embodiment of the boomerang 1 according to this invention is shown to be similar to the aforesaid embodiment in construction, except that the top surface of the central body 10 has a circular through hole 12 which extends through the bottom surface of the central body 10 and which surrounds the axis passing through the center point 11. As such, the weight of the boomerang 1 is decreased, and the gyration stability of the boomerang 1 is increased. It is noted that the through hole 12 can have a rectangular or triangular shape.

Further, the boomerang 1 of this invention can be configured to have four interconnecting portions and four blades which are angularly displaced from one another so as to achieve similar flight characteristics.

The advantages of the boomerang 1 of this invention are as follows:

1. Since the blades 22 are provided with the bent portions 226 that are defined by the bent lines 222 and the trailing edges 224 so as to create lift during flight of the boomerang 1, compared to the conventional boomerang with the complicated airfoil structure, the boomerang 1 of this invention is easy to fabricate, and can be manufactured at a relatively low cost. Besides, the boomerang 1 has a reduced weight to ensure safety of the thrower and bystanders.

2. The offset distance (X) can be determined according to the thickness and material of the boomerang 1 so as to vary the height of flight of the boomerang 1. In addition, the length and width of the bent portion 226 and the included angles θ2 can be varied to change the flight range of the boomerang 1. Thus, the boomerang 1 can be designed to perform different flight patterns, and is suitable for use in spatial and narrow spaces.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A boomerang made from a flat sheet material, comprising:

a central body with an outer periphery surrounding a center point, said central body having top and bottom surfaces that are substantially parallel to each other and that are symmetrical relative to a horizontal plane;

a plurality of interconnecting portions integrally formed with said outer periphery, and angularly displaced from one another about the center point, each of said interconnecting portions extending outwardly and along a radial axis, and terminating at a boundary region; and a plurality of blades integrally and respectively formed with said interconnecting portions, and angularly displaced from one another, each of said blades including leading and trailing edges which are opposed to each other in one of clockwise and counterclockwise directions when said blades are turned about an axis that is normal to the horizontal plane and that passes through the center point, and which are symmetrical relative to a middle line, each of said blades further including a distal end which is opposed to said boundary region along the middle line and which joins said leading and trailing edges respectively at leading and trailing junctures, wherein, the middle line intersects the radial axis to form an obtuse included angle therewith, which faces towards said leading edge of a respective one of said blades, each of said blades further including a bent line which extends towards said distal end and which is positioned between the middle line and said trailing edge such that said bent line and said trailing edge define a bent portion which faces towards said leading edge, said bent portion forming an obtuse included angle with the horizontal plane.

2. The boomerang of claim 1, wherein said plurality of interconnecting portions include three of said interconnecting portions, and said plurality of blades include three of said blades.

3. The boomerang of claim 1, wherein said central body, said interconnecting portions and said blades are of substantially the same thickness.

4. The boomerang of claim 1, wherein said top surface has a through hole which extends through said bottom surface and which surrounds the axis.

5. The boomerang of claim 4, wherein said through hole is a circular hole.

* * * * *